US005722453A

United States Patent [19]

Huxhold

[11] Patent Number: 5,722,453

[45] Date of Patent: Mar. 3, 1998

[54] HOSE BUDDY

[76] Inventor: Robert William Huxhold, 2404 Chandler Rd., Bellevue, Nebr. 68005

[21] Appl. No.: 797,052

[22] Filed: Feb. 12, 1997

[51] Int. Cl.[6] ..... B65H 75/38

[52] U.S. Cl. ..... 137/355.28; 137/355.16

[58] Field of Search ..... 137/355.28, 355.16

[56] References Cited

U.S. PATENT DOCUMENTS

| | | | |
|---|---|---|---|
| 3,171,430 | 3/1965 | Lovell et al. | 137/355.27 |
| 4,671,315 | 6/1987 | Gardner | 137/355.28 |
| 4,757,838 | 7/1988 | McGullion | 137/355.27 |
| 5,211,351 | 5/1993 | DeClerck | 137/355.27 |
| 5,388,609 | 2/1995 | Ghio et al. | 137/355.27 |

*Primary Examiner*—A. Michael Chambers
*Attorney, Agent, or Firm*—Patent & Trademark Services; Thomas Zack; Joseph H. McGlynn

[57] ABSTRACT

An apparatus for transporting and loading a hose, especially a large diameter water hose such as used on a fire truck. An upper opened rectangular box like cage structure has several interconnected tubular frame members including two side arcuate shaped frame members. Between the arcuate frame members are a series of spaced generally parallel rollers used to cradle a rolled hose. Lower frame wheels and a detachable handle permit the frame and its contents to be easily moved along the ground. Since the rolled hose engages the spaced reduced friction rollers, it may easily be removed from or placed in its rolled position within the frame. All components are made of moisture resistant material to prevent rusting.

7 Claims, 1 Drawing Sheet

HOSE BUDDY

BACKGROUND OF THE INVENTION

Moving heavy objects short distances has often been done with wheel barrels or other wheeled containers to speed up the movement and to reduce the occurrence of injuries to personnel. One area where such movers find particular applicability is in the movement of large heavy and bulky hoses commonly used and found on fire trucks. After use, these large diameter hoses need to uncoupled from the fire hydrant and its adjoining hose sections and rolled up to get air and water removed from them before placing them back on the fire truck. In some situations the hoses may be blocks away from the fire truck when this reloading process starts. This may require the truck to be either backed up to where the hoses are either laid out or rolled in piles; or the hoses may have to be carried back to the truck. Both alternatives can create dangerous situations.

The present invention seeks to avoid these undesired situations by providing for a hose mover which allows the hose to be easily loaded in and removed from the mover while providing for the hose's rapid and convenient transport when loaded and rolled in the mover.

DESCRIPTION OF THE PRIOR ART

Hose storage containers or transporters, or both, have been used for some time by the general public and personnel having different occupations. For example, in U.S. Pat. No. 3,171,430 to Lovell et al. shipboard fire fighting hoses are discloses wherein two hoses baskets are balanced between a vertical support section.

In U.S. Pat. No. 4,757,838 to McGullion a fire hose reel is described which has a vertical axis and is pivotally mounted on a base to thereby allow the hose to be unwound at any desired angle.

The hose loader and unloader set forth in the invention to DeClerck (U.S. Pat. No. 5,211,351) includes a pair of rollers, a frame and a cradle assembly with provision to attach the frame to a vehicle. U.S. Pat. No. 5,388,609 to Ghio et al. discloses a hose reel cart has a vertically disposed reel mounted to a tubular wheeled cart. The present invention provides for a hose cradle frame with several rollers to engage a seated hose and rollers to permit movement of the frame by a handle as more further set forth in this specification.

SUMMARY OF THE INVENTION

This invention relates to hose transport apparatus having a hose cradle frame with several rollers that engage a seated hose, and ground engaging rolling members to permit the frame to be moved. A handle attached to the frame permits users to easily transport the frame and hose.

It is the primary object of the present invention to provide for an improved apparatus to transport and load a hose.

Another object is to provide for such an apparatus wherein friction reducing rollers engage a hose to permit the hose's easy loading and unloading.

These and other objects and advantages of the present invention will become apparent to readers from a consideration of the ensuing description and the accompanying drawings.

DESCRIPTION OF THE PREFERRED EMBODIMENT

Figure 1:
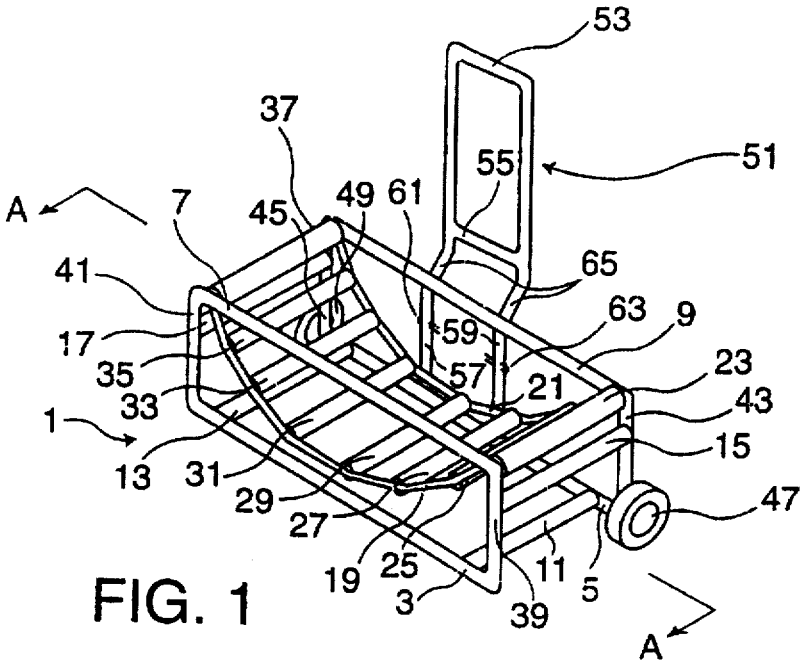
FIG. 1 is a front perspective view of the invention's preferred embodiment.

FIG. 1 is a front perspective view of the invention's preferred embodiment. An opened tubular rectangular frame structure 1 consists of four parallel straight spaced side elongated hollow tubular members 3, 5, 7 and 9 joined by four straight spaced attached perpendicular hollow tubular frame members 11, 13, 15 and 17. The lower front member 3 can engage the ground and support the frame and its contents when the apparatus is at rest. Located within, and forming part of this frame structure, are two parallel spaced hollow tubular arcuate shaped members 19 and 21 which extend in the same direction as the four side parallel members and are joined at their respective ends to the frame at its upper ends.

Extending between and perpendicular to the spaced arcuate shaped members 19 and 21 are eight equally spaced parallel disposed rollers designated by the numbers 23, 25, 27, 29, 31, 33, 35 and 37 as shown. Each roller is cylindrical in shape and is made of stainless steel or galvanized iron to prevent rusting. An outer plastic covering may also be used on each roller. Alternately, the rollers may also be made of a plastic material, such as PVC (polyvinyl chloride), shaped like a pipe. Interior ball bearing rollers located at the two ends of each roller's central shaft permit its free rotation around the central shaft.

The central roller shafts (not shown) are rotatably mounted to the arcuate frame members and the two elongated top frame members 7 and 9 (for the uppermost end rollers 23 and 37). Four vertical upright hollow tubular frame members 39, 41 , 43 and 45 are joined to the ends of the four parallel elongated members 3, 5, 7 and 9 to form part of the interconnected rectangular box shaped frame. Vertically disposed stainless steel sheets (not shown) having straight top edges aligned with top frame edges 7 and 9 and having arcuate side edges may line the opposite frame sides to prevent wear to the hose and prevent snagging of the hose's end couplings sections.

Attached to the frame structure of FIG. 1 at its rear are two spaced ground engaging wheels 47 and 49 and the tubular upright bent handle assembly 51. Each wheel rides on its own central shaft and is conventionally attached to the frame near where its vertical members 43 or 45 are joined to the elongated lower horizontally disposed members 5, 11 and 13. Ball bearing rollers may surround the wheel's central shaft on which the wheels ride to reduce friction between the rotatable members.

The vertically disposed handle assembly 51 is made up of a U-shaped upper section 53 having a rigid support joining member 55 all of which is detachably and slidably joined to two lower upright support opened tubular members 57 and 59. The two lower spaced ends of the U-shaped section 53 fit into the opened upper ends of members 57 and 59. Holes within the upper members 57 and 59 and the lower opened ends of the spaced members of section 53 permit the insertion of two cotter pins 61 and 63 to join the handle to the frame. Pin rings with retaining chains could be used in place of the cotter pins to retain the upright tubular members 57 and 59 to the handle.

An intermediate joining portion of section 53 is offset upward and has a rear angle at about 45 degrees in the area 65 located above its lower vertically disposed free ends and below its upper vertically disposed joining horizontal cross member 55. This offset in the tubular members permit greater leverage to be applied to the frame when pivoted about the two lower wheels 47 and 49 similar to the pivoting action used to lift and move a wheel barrel. In this way the weight of the apparatus when it is moved and loaded with a hose or hose sections resides on the two support wheels permitting their easy movement. When at rest the frame's weight is distributed between the two rear wheels 47 and 49 and the front ground engaging frame member 3.

Figure 2:
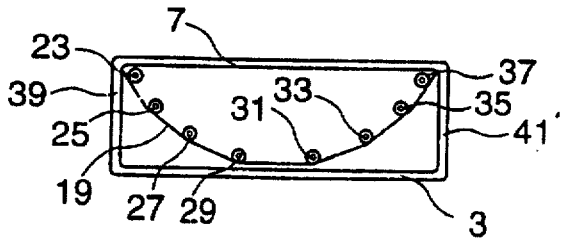
FIG. 2 is a cross sectional view of the FIG. 1 frame as viewed in the direction of the arrows along lines A—A in the FIG. 1 embodiment.

FIG. 2 is a cross sectional view of the FIG. 1 frame as viewed in the direction of the arrows along lines A—A in the FIG. 1 embodiment. The front arcuate shaped tubular frame member 19 is joined to the rigid tubular frame member 7 at its upper most ends and the lower front tubular frame member 3 at near the midpoint of the arch formed. This provides a rigid and firm joining of the arcuate member to the frame. A similar rigid joining to the rear frame members is used for the rear arcuate shaped member 21. The eight rollers are equally spaced from each other along the arcuate lengths of members 19 and 21 and extend there between to form, along with the supporting frame members, a cradle like arcuate shaped opened structure in which the rolled hose can be stored for transport.

Figure 3:
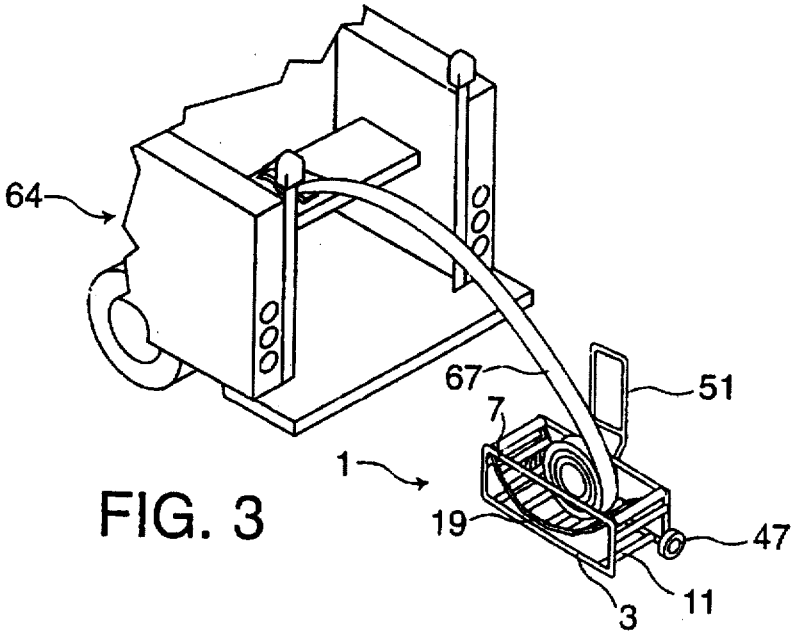
FIG. 3 shows a side perspective view of the FIG. 1 embodiment as it could be used by a fire fighter.

FIG. 3 shows a side perspective view of the FIG. 1 embodiment as it could be used by a fire fighter when loading a hose on a fire truck. The spaced rollers in their arcuate configuration engage the hose and allow for its easy reduced friction retrieval from the frame. Unloading of the frame loaded hose is easily done by rolling the apparatus adjacent to the fire truck and pulling on the hoses as the rollers permit the hose to be removed in a rapid and convenient manner.

In one embodiment the four parallel members 3–9 were about 39 inches long while the connecting side members 11, 13, 15 and 17 were 13 inches long. The height of each of the four vertical frame member 39–45 was also 13 inches thereby providing for a frame or cage with a length more than twice its height or width. The two wheels were each 7 inches in diameters with a 0.5 inch axle bolt. The cylindrical tubular covering for the roller was about 10.75 inches long with a ⅛ inch center support shaft have self locking end nuts to mount the rollers to the frame. The handle 51 was about 39 inches long and 10.75 inches in width. All members were made of materials to resist moisture such as SH 40 PVC (polyvinyl chloride) plastic pipe for the rollers' cylindrical outer surface and stainless steel or galvanized iron for the frame members.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An apparatus for transporting and loading hose comprising:

an opened frame structure having interconnected elongated frame members including two opposite spaced arcuate shaped members which form an opened upper cradle, said frame having front and rear members;

a plurality of spaced rollers disposed between said arcuate shaped frame members and extending there between and mounted thereon and adapted to engage and receive a rolled hose for transporting;

an upright handle assembly attached to said frame to one or more rear members; and rotatable ground engaging members attached to at the frame's lower rear structure, excluding any of the arcuate shaped members, said ground engaging members being adapted to permit the frame and rollers to be moved along the ground.

2. The invention as claimed in claim 1, wherein said handle assembly is detachably mounted to said frame structure on the same frame side as the rear rotatable ground engaging members.

3. The invention as claimed in claim 2, wherein said frame structure consists of tubular members joined together near their ends to form an opened rectangular frame cage in which other than said arcuate frame members, said rollers being mounted generally perpendicular to the two arcuate frame members.

4. The invention as claimed in claim 3, wherein said tubular frame members forming the rectangular frame and arcuate shaped opposite frame members are hollow tubes made of moisture resistant materials.

5. The invention as claimed in claim 4, wherein said rotatable ground engaging members are two spaced wheels attached to the lower rear portion of the rectangular frame members.

6. The invention as claimed in claim 5, wherein each of said rollers are equally spaced from each other long the length of said arcuate members.

7. The invention as claimed in claim 6, wherein each of said rollers are disposed in a generally parallel relationship relative to the other rollers.

* * * * *